US008348414B2

(12) United States Patent
Doo

(10) Patent No.: US 8,348,414 B2
(45) Date of Patent: Jan. 8, 2013

(54) INK JET RECORDING APPARATUS EQUIPPED WITH CUTTING HEAD AND ULTRAVIOLET LIGHT IRRADIATION DEVICE

(75) Inventor: Harumichi Doo, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 657 days.

(21) Appl. No.: 12/512,949

(22) Filed: Jul. 30, 2009

(65) Prior Publication Data

US 2011/0026998 A1 Feb. 3, 2011

(51) Int. Cl.
*B41J 11/00* (2006.01)

(52) U.S. Cl. ..... 347/102; 347/5; 347/14; 347/22; 347/104; 400/621; 101/116; 101/117; 101/128.4; 33/18.1; 33/18.2

(58) Field of Classification Search ..... None
See application file for complete search history.

(56) References Cited

U.S. PATENT DOCUMENTS 3,550,276 A * 12/1970 Kramer et al. ..... 33/18.1
4,835,872 A * 6/1989 Alcantara et al. ..... 33/18.1
6,076,460 A * 6/2000 Kagawa ..... 101/128.4
6,270,215 B1 * 8/2001 Miyasaka et al. ..... 347/104
6,575,553 B1 * 6/2003 Williams et al. ..... 347/22
6,832,831 B2 * 12/2004 Shima et al. ..... 347/102
6,926,400 B2 * 8/2005 Kelley ..... 347/104
6,990,899 B2 * 1/2006 Kato ..... 101/117
7,232,212 B2 * 6/2007 Iwase ..... 347/102
7,306,388 B2 * 12/2007 Acher ..... 400/621
7,396,173 B2 * 7/2008 Ahne et al. ..... 400/621
7,794,076 B2 * 9/2010 Nakano et al. ..... 347/102
2003/0184631 A1 * 10/2003 Suzuki et al. ..... 347/102
2007/0146458 A1 * 6/2007 Perego ..... 347/102

* cited by examiner

*Primary Examiner* — Matthew Luu
*Assistant Examiner* — John P Zimmermann
(74) *Attorney, Agent, or Firm* — Lee, Hong, Degerman, Kang & Waimey

(57) ABSTRACT

A printing apparatus capable of performing printing and cutting operations is presented. The printing apparatus including a supporting member for supporting a medium, an ink head comprising a nozzle for discharging ultraviolet light curable ink onto the medium and coupled to the guide rail in a freely moveable manner for moving the ink head in the second direction, a cutting head comprising a cutter for cutting the medium and coupled to the guide rail in a freely moveable manner for moving the cutting head in the second direction, and an ultraviolet light irradiation device coupled to the ink head for irradiating ultraviolet light onto the ultraviolet light curable ink discharged on the medium during the printing operation, wherein at least a portion of the medium is irradiated by the ultraviolet light after a region of the recording medium is cut by the cutter.

21 Claims, 8 Drawing Sheets

INK JET RECORDING APPARATUS EQUIPPED WITH CUTTING HEAD AND ULTRAVIOLET LIGHT IRRADIATION DEVICE

BACKGROUND OF THE INVENTION

1. Field of the Invention

The present invention relates to an ink jet recording apparatus equipped with a cutting head and an ultraviolet light irradiation device.

2. Discussion of the Related Art

Ink jet recording apparatuses equipped with an ink head for discharging ink onto a recording medium, such as a sheet of paper, and a cutting head for cutting the recording medium have been known in the art, for example, U.S. Pat. No. 7,121,750. The ink jet recording apparatus described in U.S. Pat. No. 7,121,750 is equipped with a guide rail extending in a left-right direction, additionally, an ink head and a cutting head are coupled with the guide rail. The ink head and the cutting head move in a left-right direction along the guide rail. Furthermore, the ink jet recording apparatus described above is equipped with a platen for supporting the recording medium. The ink head and the cutting head are disposed opposite to the platen.

Additionally, an ink jet recording apparatus that discharges ultraviolet light curable ink from the ink head is known in the art, for example, U.S. Pat. No. 7,232,212. The ink jet recording apparatuses may also be equipped with a device for irradiating ultraviolet light to cure the ink on a recording medium which has been discharged from the ink head. The ultraviolet light irradiation device may irradiate ultraviolet light over the entire region of the recording medium in the left-right direction.

As described in U.S. Pat. No. 7,232,212, an ultraviolet light irradiation device that is attached to an ink head and is carried with the ink head in the left-right direction is also known in the art. The aforementioned ultraviolet light irradiation device is capable of irradiating ultraviolet light on a desired portion of the recording medium, thereby suppressing unnecessary irradiation of ultraviolet light.

A review of the prior art reveals that problems may occur if the ultraviolet light irradiation device is added without any contrivance to the ink jet recording apparatus equipped with the ink head and the cutting head. Specifically, in the ink jet recording apparatus described above, the ultraviolet light curable ink may adhere to the platen. Thus, as a result, the cut-out operation performed by the cutting head may not be properly performed due to the ink cured on the platen.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In accordance with an embodiment, printing apparatus capable of performing printing and cutting operations is presented. The printing apparatus includes a supporting member for supporting a medium, a first transfer mechanism for transferring the medium in a first direction, a guide rail that extends in a second direction, an ink head comprising a nozzle for discharging ultraviolet light curable ink onto the medium and coupled to the guide rail in a freely moveable manner for moving the ink head in the second direction, a cutting head comprising a cutter for cutting the medium and coupled to the guide rail in a freely moveable manner for moving the cutting head in the second direction, a second transfer mechanism for moving the ink head and the cutting head in the second direction during the printing operation and for moving the cutting head in the second direction during the cutting operation, and an ultraviolet light irradiation device coupled to the ink head for irradiating ultraviolet light onto the ultraviolet light curable ink discharged on the medium during the printing operation, wherein at least a portion of the medium is irradiated by the ultraviolet light after a region of the recording medium is cut by the cutter.

According to one feature, the printing apparatus further includes a sliding groove disposed opposite to the cutter on the supporting member, wherein the sliding groove comprises a sliding member for receiving the cutter during the cutting operation and having a greater lubricity for the cutter than for the supporting member.

According to another feature, the printing apparatus further includes a plurality of holes formed on the supporting member and a suction device for attracting the medium to the supporting member via the plurality of holes. Additionally, the position of each of the plurality of holes is shifted from a cut position and an irradiated region in the first direction. Alternatively, a first portion of the plurality of holes is located in front of a cut position and an irradiated region, and a second portion of the plurality of holes is located at the rear of the cut position and the irradiated region. Still, a first portion of the plurality of holes may be located in front of a cut position and an irradiated region, and a second portion of the plurality of holes is located at the rear of the cut position and the irradiated region.

According to yet another feature, the printing apparatus further includes a coupling mechanism that detachably couples the ink head and the cutting head, wherein the coupling mechanism connects the ink head and the cutting head at the time of the printing operation, and releases the connection between the ink head and the cutting head at the time of the cutting operation.

According to still yet another feature, the printing apparatus further includes a carriage coupled to the second transfer mechanism for transferring the cutting head in the second direction. Additionally, the ultraviolet light irradiation device is located between the ink head and the cutting head. Finally, the first direction is a forward-back direction, and the second direction is a left-right direction.

In accordance with another embodiment, a method of printing and cutting is presented. The method includes transferring a recording medium in a first direction via a first transfer mechanism, wherein the recording medium is supported via a supporting member, discharging ultraviolet light curable ink from an ink head onto the recording medium, wherein the ink head is slideably coupled to a guide rail in a freely moveable manner for moving the ink head in a second direction, cutting the recording medium using a cutting head comprising a cutter, wherein the cutting head is slideably coupled to the guide rail in a freely moveable manner for moving the cutting head in the second direction, moving the ink head and the cutting head in the second direction via a second transfer mechanism while printing and moving the cutting head in the second direction while cutting, irradiating ultraviolet light onto the ultraviolet light curable ink discharged on the recording medium during the printing, wherein at least a portion of the recoding medium is irradiated by the ultraviolet light after a region of the recording medium is cut by the cutter.

In accordance with yet another embodiment, printing apparatus capable of performing printing and cutting operations is presented. The printing apparatus includes, a supporting member for supporting a medium, a first transfer mechanism for transferring the medium in a first direction, a guide rail that extends in a second direction, an ink head comprising a nozzle for discharging ultraviolet light curable ink onto the medium and coupled to the guide rail in a freely moveable manner for moving the ink head in the second direction, a cutting head comprising a cutter for cutting the medium and coupled to the guide rail in a freely moveable manner for moving the cutting head in the second direction, a second transfer mechanism for moving the ink head and the cutting head in the second direction during the printing operation and for moving the cutting head in the second direction during the cutting operation, an ultraviolet light irradiation device coupled to the ink head for irradiating ultraviolet light onto the ultraviolet light curable ink discharged on the medium during the printing operation, a coupling mechanism that detachably couples the ink head and the cutting head, wherein the coupling mechanism connects the ink head and the cutting head at the time of the printing operation, and releases the connection between the ink head and the cutting head at the time of the cutting operation, wherein at least a portion of the medium is irradiated by the ultraviolet light after a region of the recording medium is cut by the cutter.

These and other embodiments will also become readily apparent to those skilled in the art from the following detailed description of the embodiments having reference to the attached figures, the invention not being limited to any particular embodiment disclosed.

DETAILED DESCRIPTION OF THE PREFERRED EMBODIMENTS

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

Figure 1:
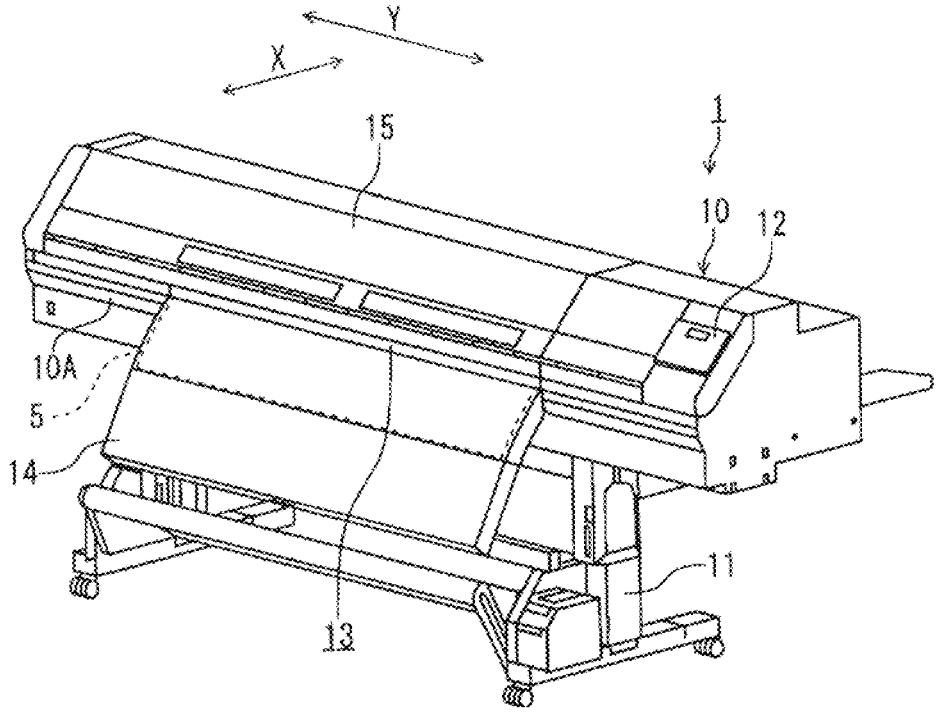
FIG. 1 is a perspective view of an ink jet printer according to an embodiment of the present invention.

FIG. 1 illustrates an ink jet recording apparatus, such as ink jet printer 1, in accordance with an embodiment of the invention. The ink jet recording apparatus in accordance with the present embodiment is not limited to the ink jet printer 1 illustrated in FIG. 1 and may comprise various forms of ink jet printers.

Figure 3:
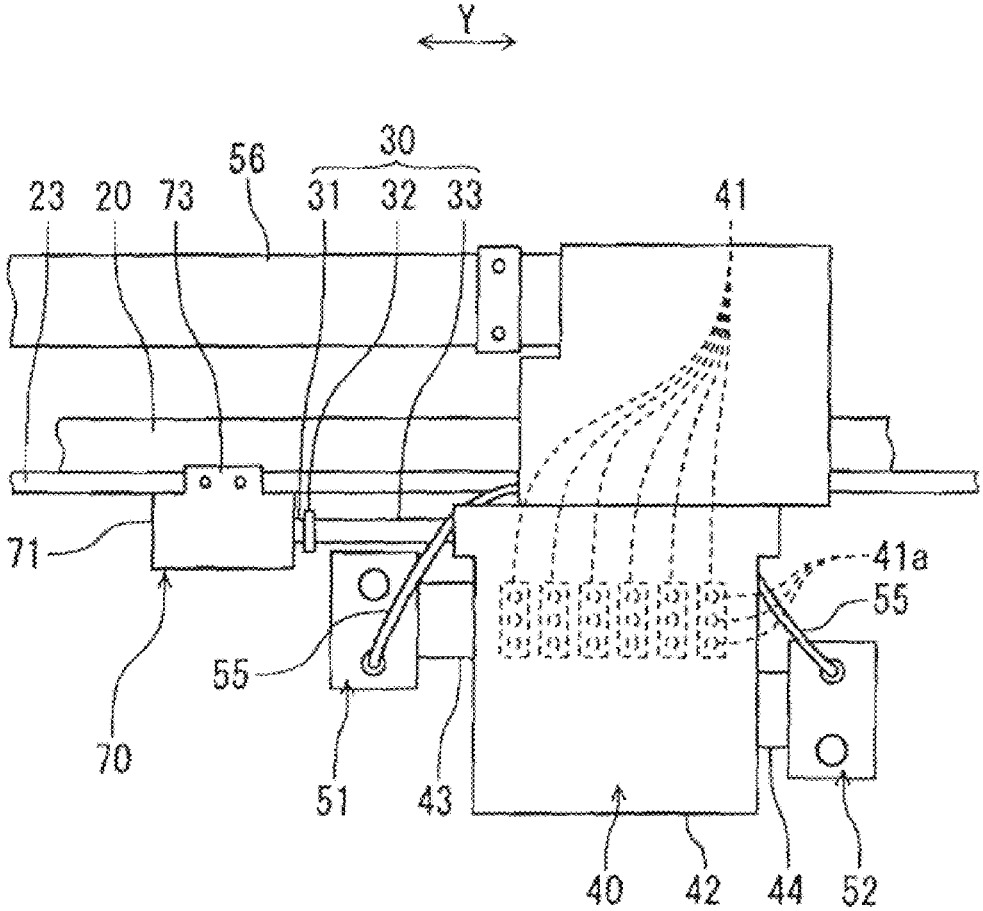
FIG. 3 is a plan view illustrating a cutting head, an ink head and an ultraviolet light irradiation device according to an embodiment of the present invention.
Figure 4:
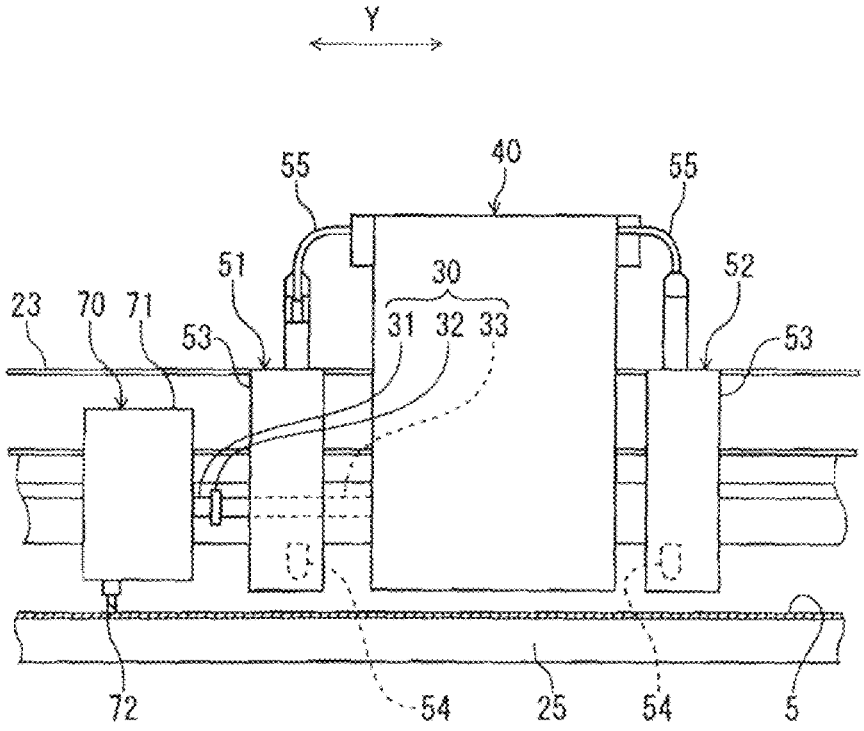
FIG. 4 is a front view illustrating the cutting head, the ink head and the ultraviolet light irradiation device illustrated in FIG. 3.

The ink jet printer 1 may be equipped with an ink head 40 and a cutting head 70 (see FIG. 3 and FIG. 4). The ink jet printer 1 is capable of performing printing and cut-out operations with respect to a sheet of recording paper 5.

As illustrated in FIG. 1 mark Y refers to a first scanning direction, and a mark X refers to a second scanning direction. More specifically, the second scanning direction is a direction perpendicular to the first scanning direction. The ink head 40 and the cutting head 70 move with respect to the first scanning direction and the recording paper 5 moves with respect to the second scanning direction.

The ink jet printer 1 is provided with a main body 10 having a casing 10A that extends in the first scanning direction, and legs 11 that support the main body 10. An operation panel 12 is provided on a side of the main body 10. Although not illustrated, the operation panel 12 may be equipped with a display section that displays operation status, a cursor key for designating the positions of the ink head 40 and the cutting head 70, a region setting key for designating a region within a specified portion of the recording paper 5 for printing or cutting based on an image data signal, and an operation start key for starting printing or cutting from the region designated by the region setting key.

A front cover 15, which may be freely opened and closed, is mounted on an upper portion of the main body 10. A discharge port 13 for discharging the recording paper 5 is formed on the lower side of the main body 10. A guide 14 is provided the front of the main body and below the discharge port 13. The guide 14 guides the recording paper 5 discharged from the discharge port 13 in a forwardly diagonal downward direction.

It is noted that, in the current embodiment, the left-right direction refers to the first scanning direction, and the front-rear direction refers to the second scanning direction. Additionally, the front-rear, left-right, and up-down directions correspond to directions as seen from a position of an operator (not shown) facing the front of the discharge port 13, respectively. It is noted, however, that the front-rear, left-right and up-down directions as seen from a position of an operator are relative, and may change depending on the positional relation between the operator and the ink jet printer 1. For this reason, as stated above, the left-right direction refers to the first scanning direction and the front-rear direction refers to the second scanning direction.

Figure 2:
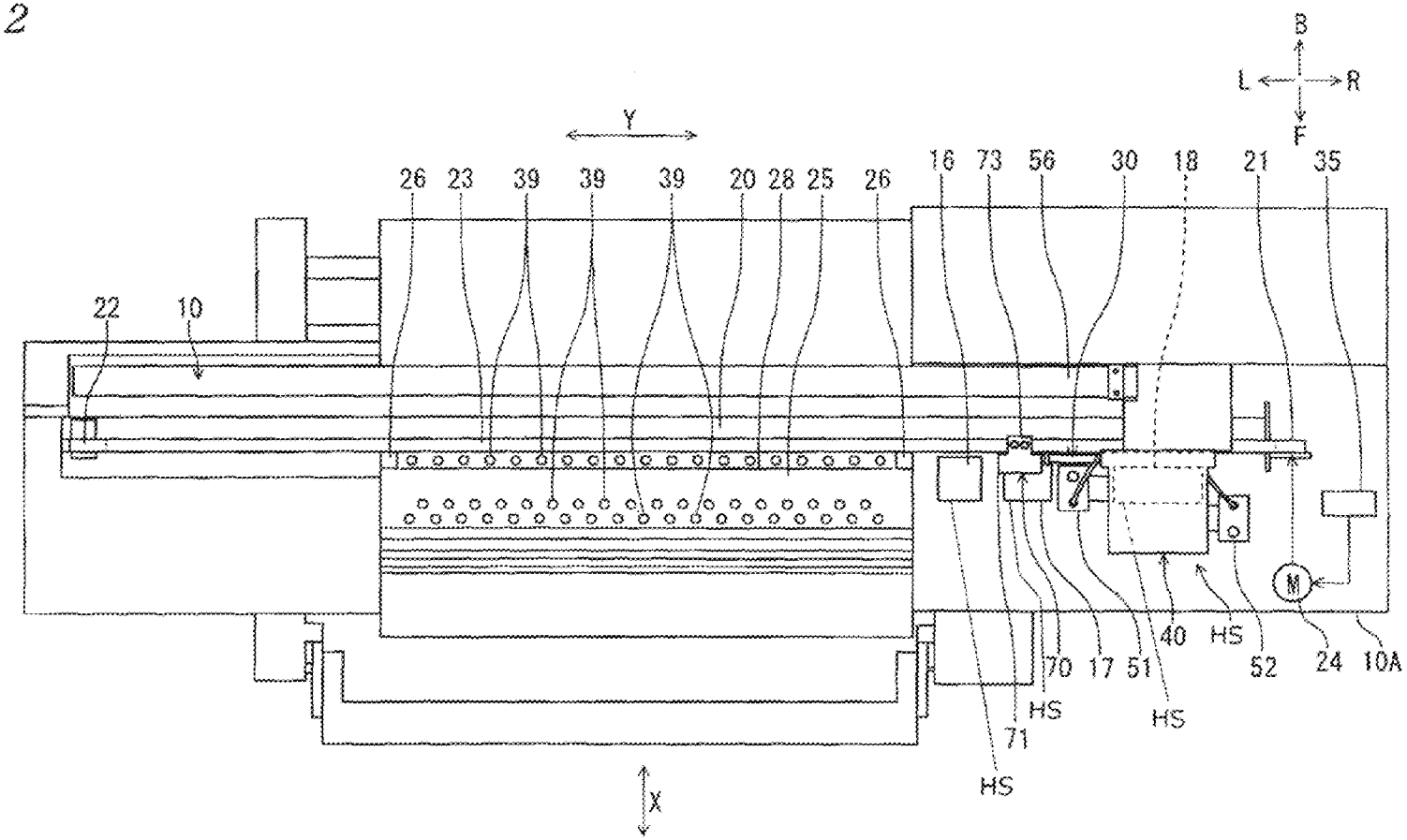
FIG. 2 is a plan view illustrating the internal structure of the ink jet printer illustrated in FIG. 1.

Next, the internal structure of the main body 10 will be described with respect to FIG. 2. As shown in FIG. 2, a guide rail 20 extending in the left-right direction is provided inside the main body 10. A platen 25 is disposed in a central area and in front of the guide rail 20.

The platen 25 is a member for supporting the recording paper 5 during printing by the ink head 40 and during cutting by the cutting head 70. More specifically, printing and cutting of the recording paper 5 is conducted on the platen 25.

A first pulley 21 is provided adjacent to the right end section of the guide rail 20, and a second pulley 22 is provided adjacent to the left end section of the guide rail 20. An endless belt 23 is wound around the first pulley 21 and the second pulley 22.

A motor 24 is coupled to the first pulley 21. The belt 23 is driven between the first pulley 21 and the second pulley 22 when the motor 24 drives the first pulley 21. A control device 35 is connected to the motor 24. The motor 24 is a motor that can be freely rotated in forward and reverse directions. The control device 35 controls the motor 24, thereby controlling movements of a carriage 73.

It is noted that, in accordance with the present embodiment, the motor 24 drives the first pulley 21. However, the motor 24 may drive the second pulley 22.

As shown in FIG. 2, a pair of upper and lower rollers 26 are provided at the left end section and the right end section of the platen 25 for feeding the recording paper 5 in the second scanning direction X (FIG. 2 only illustrates the upper rollers 26). Among the pair of upper and lower rollers 26, one of the rollers 26 is a driving roller that rotates itself, and the other roller 26 is a pinching roller for pinching the recording paper 5 with the driving roller.

The operation of the driving rollers is controlled by the control device 35. These rollers 26 form a transfer mechanism that transfers the recording paper 5 in the second scanning direction. Additionally, in accordance with another embodiment, the positions of the pair of upper and lower rollers 26 may not be limited to the left end section and the right end section of the platen 25.

The cutting head 70 will be described with respect to FIGS. 3 and 4. As shown in FIG. 4, the cutting head 70 may be equipped with a cutter 72, a holder 71 that retains the cutter 72, and the carriage 73 (see FIG. 3) provided on the holder 71. The holder 71 engages with the guide rail 20, and is guided by the guide rail 20 along the first scanning direction.

As shown in FIG. 3, the carriage 73 is affixed to the belt 23 and is transferred in the left and right directions as the belt 23 is driven. the carriage 73 moves to the left as the motor 24 rotates in one direction, and the carriage 73 moves to the right as the motor 24 rotates in a second direction. In accordance with the present embodiment, the carriage 73 is built in the cutting head 70. The carriage 73 may be formed as one piece with the holder 71, or may be formed independently.

It should be noted, however, that the carriage 73 is not limited to the carriage 73 that is built in the cutting head 70. The carriage 73 may be provided independently of the cutting head 70. More specifically, the carriage 73 may be coupled to the cutting head 70 in a manner such that the carriage 73 may be attachable to the cutting head 70. Furthermore, the carriage 73 may be built in the ink head 40. Alternatively, the carriage 73 may be provided independently of both of the cutting head 70 and the ink head 40.

The cutting head 70 is a head for cutting the recording paper 5. During a cut operation, the cutter 72 is lowered and pushed against the recording paper 5 and the cutting head 70 moves in the first scanning direction in response to a movement of the carriage 73. Additionally, the recording paper 5 is transferred by the rollers 26 in the second scanning direction. Thus, an arbitrary portion of the recording paper 5 can be cut out as a result or the movement of the cutter 72 and the recording paper 5.

It is noted that the cutting operation on the recording paper 5 by the cutter 72 not only includes cutting the entire recording paper 5, but also includes cutting a portion of the recording paper 5. In other words, cutting the recording paper 5 by the cutter 72 is not limited to completely penetrating through the entire cutting paper 5 by the cutter 72.

For example, the recording paper 5 may comprise a plurality of layers, and the cutter 72 is moved with respect to the recording paper 5 and may only penetrate an upper portion of one of the layers of the recording paper 5. Accordingly, the cutter 72 may cut a portion of the recording paper 5.

FIG. 3 also illustrates the ink head 40. The ink head 40 is a head that ejects ink toward the recording paper 5. As shown in FIG. 3, the ink head 40 includes a plurality of print heads 41 each having a plurality of nozzles 41*a* for ejecting ink, and a print head carriage 42 that supports the print heads 41.

It is noted that FIG. 3 shows an enlarged view of the nozzles 41*a*, and for the sake of convenience also shows a limited number of nozzles 41*a*. According to current embodiment, the size of the nozzles 41*a* is much smaller than illustrated in FIG. 3, and a greater number nozzles 41*a* are formed in the print head 41. The print head carriage 42 engages with the guide rail 20 in a manner freely moveable in the left-right direction.

The print heads 41 eject ink droplets downward from the nozzles. An ink cartridge filled with ink is attached to the rear portion of the main body 10 (not illustrated). The print heads 41 are connected to the ink cartridge via tubes (not illustrated) disposed within a cableveyor 56 or the like.

Ink is supplied to the print heads 41 from the ink cartridge described above. It is noted that the ejection operation of the ink head 40 is also controlled by the control device 35.

The ink head 40 ejects ink that is cured when irradiated with ultraviolet light, in other words, the ink head 40 ejects ultraviolet light curable ink. More specifically, at least one of the print heads 41 ejects ultraviolet light curable ink. The ink jet printer 1 is equipped with a first ultraviolet light irradiation device 51 and a second ultraviolet light irradiation device 52.

The first ultraviolet light irradiation device 51 is mounted to the left side of the print head carriage 42 via a connection member 43. The first ultraviolet light irradiation device 51 is located between the ink head 40 and the cutting head 70. The second ultraviolet light irradiation device 52 is mounted to the right side of the print head carriage 42 via a connection member 44.

The first ultraviolet light irradiation device 51 and the second ultraviolet light irradiation device 52 are disposed with their centers located in the front-rear direction. The first ultraviolet light irradiation device 51 is disposed behind the second ultraviolet light irradiation device 52

As shown in FIG. 4, the first ultraviolet light irradiation device 51 is equipped with a case 53, a light source 54 provided within the case 53, and a cable 55 for supplying electricity to the light source 54. The light source 54 is formed from an ultraviolet light emitting diode. The cable 55 is connected to a power supply (not illustrated) via the cableveyor 56 (see FIG. 2).

The second ultraviolet light irradiation device 52 has a similar structure as the first ultraviolet light irradiation device 51. The irradiation operation of the first and second ultraviolet light irradiation devices 51 and 52 is also controlled by the control device 35.

It is noted that the ultraviolet light irradiation devices 51 and 52 are not limited to ultraviolet light emitting diodes. Other irradiation devices, such as, halogen lamps may be used in the ultraviolet light irradiation devices 51 and 52.

As shown in FIG. 3, a coupling mechanism 30 is provided at the rear of the first ultraviolet light irradiation device 51 for detachably coupling the cutting head 70 and the ink head 40. The coupling mechanism 30 is equipped with a coupling member 31 extending from the holder 71 to the right, a magnet 32 provided at the right end of the coupling member 31, and a coupling member 33 extending from the rear left side of the print head carriage 42 to the left. The left end section of the coupling member 33 is formed from a magnetic material, such as iron.

The coupling member 33 is attracted by the magnet 32 and accordingly, the cutting head 70 and the ink head 40 are coupled to each other via the coupling mechanism 30. The cutting head 70 moves in the first scanning direction according to movements of the belt 23.

Therefore, as the cutting head 70 and the ink head 40 are coupled to each other, the ink head 40 moves in the first scanning direction together with the cutting head 70. At the time of printing, the cutting head 70 and the ink head 40 are coupled to each other via the coupling mechanism 30, and the ink head 40 is transferred in the first scanning direction by the carriage 73.

In the present embodiment, the coupling mechanism 30 is equipped with the magnet 32, and utilizes magnetic force. However, the coupling mechanism 30 is not limited to a magnet, and may be any structure that it can detachably couple the cutting head 70 and the ink head 40.

As shown in FIG. 2, the ink head 40 is positioned adjacent to the right end section of the guide rail 20 when the printing operation is not performed. This position may be referred to as a home position ("HP"). The ink head 40 and the casing 10A are provided with a lock mechanism (not shown) that locks the ink head 40 at the HP.

As the cutting head 70 moves to the left in a state in which the ink head 40 is locked by the lock mechanism, the connection between the cutting head 70 and the ink head 40 is released. In other words, when the carriage 73 moves to the left in the above-described state, the magnet 32 of the coupling mechanism 30 is separated from the coupling member 33 against the magnetic force of the magnet 32.

As a result, the ink head 40 remains at the HP, and the cutting head 70 moves in the first scanning direction. For example, during an operation for cutting the recording paper 5, the connection between the cutting head 70 and the ink head 40 is released, and the carriage 73 only transfers the cutting head 70 in the first scanning direction.

As shown in FIG. 2, a cap 18 may surround the nozzles 41*a* of the ink head 40 and may be provided behind the ink head 40, when the ink head 40 is located at the HP. A wiper 17 is provided to the left of the cap 18 for wiping a nozzle surface of the nozzles 41*a*. Additionally, a container 16 is provided to the left of the wiper 17 for collecting ink ejected from the ink head 40.

The container 16 is provided for collecting the ink discharged to prevent clogging. The container 16, the wiper 17, and the cap 18 form an ink head auxiliary system HS. The ink jet printer 1 may discharge ink from the nozzles 41*a*, irrespective of printing operations, in order to prevent the nozzles 41*a* of the ink head 40 from clogging.

It is noted that, in accordance with the present embodiment as described above, the HP for the ink head 40 is provided in the right end section of the main body 10. However, the HP for the ink head 40 is not limited to the right end section of the main body 10, but may be provided in the left end section thereof.

Figure 5A:
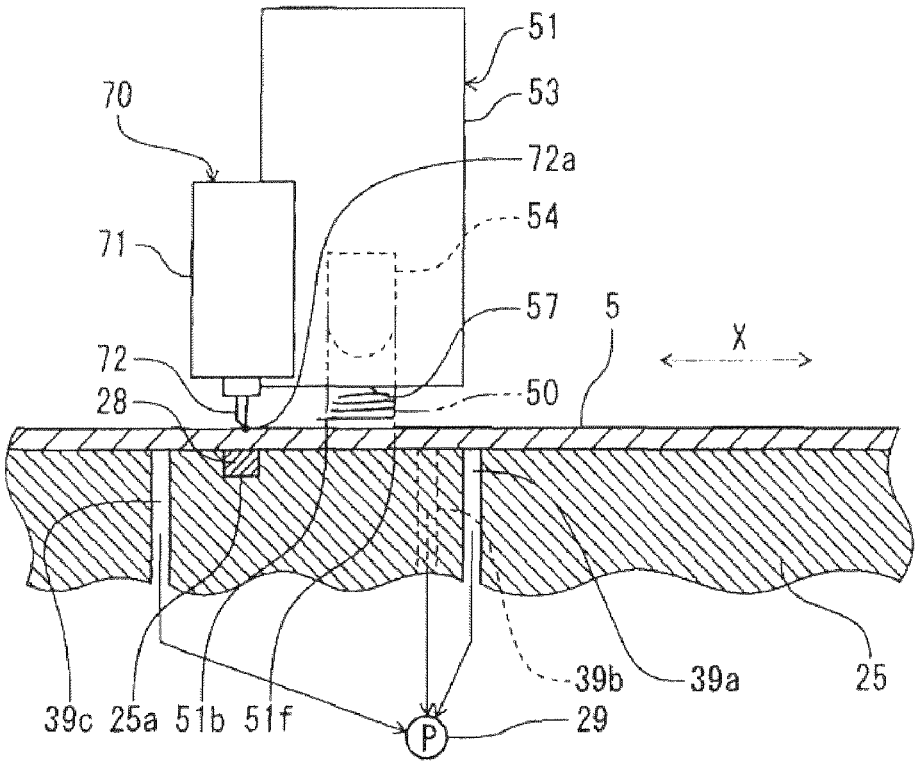
FIG. 5A is a side view of the cutting head and a first ultraviolet light irradiation device according to an embodiment of the present invention.
Figure 5B:
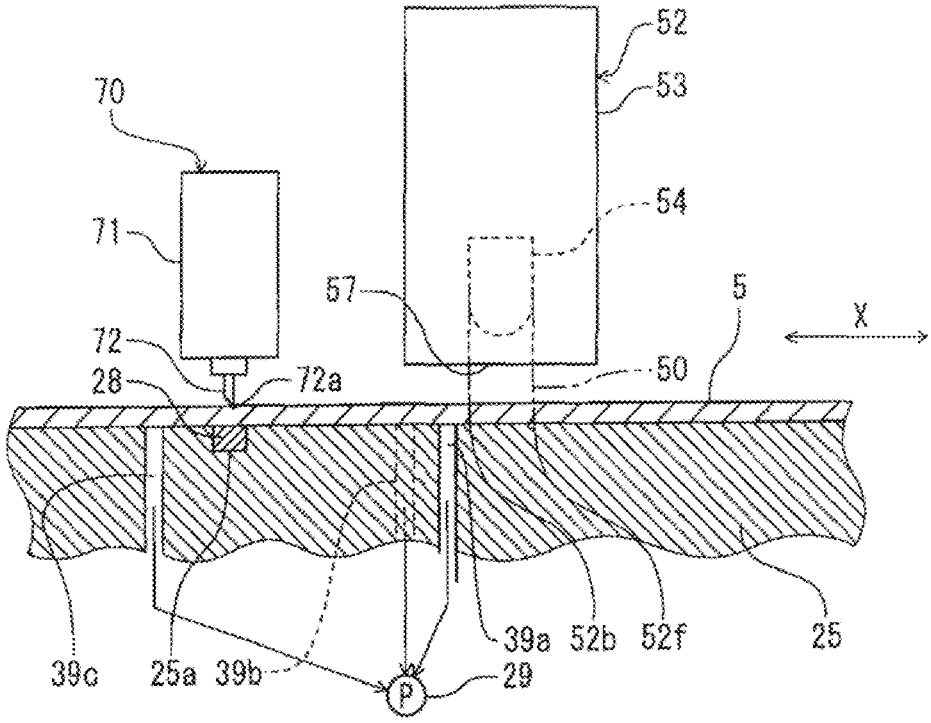
FIG. 5B is a side view of the cutting head and a second ultraviolet light irradiation device according to an embodiment of the present invention.

FIG. 5A is a side view of the first ultraviolet light irradiation device 51 and the cutting head 70. FIG. 5B is a side view of the second ultraviolet light irradiation device 52 and the cutting head 70. As illustrated in FIGS. 5A and 5B the cutting head 70 is positioned at the rear of the respective first ultraviolet light irradiation device 51 and second ultraviolet light irradiation device 52.

As shown in FIG. 5A, a downwardly receding concave groove 25*a* is formed in the platen 25 immediately below the cutter 72. The groove 25*a* is a long groove that extends in the left-right direction. A sliding member 28 is fitted in the groove 25*a*.

It is noted that the sliding member 28 extends in the left-right direction, similar to the groove 25*a* (see FIG. 2). The sliding member 28 allows the cutter 72 to more readily slide against the recording paper 5. The sliding member 28 supports the tip of the cutter 72 that penetrates the recording paper 5 in the up-down direction, such that the cutter 72 may slide more easily.

The sliding member 28 is formed from a material having a greater lubricity to the cutter 72 than to the platen 25. In the present embodiment, the sliding member 28 may be formed from Teflon. However, the material for the sliding member 28 is not particularly limited to Teflon, and may be formed from a similar material.

Figure 6:
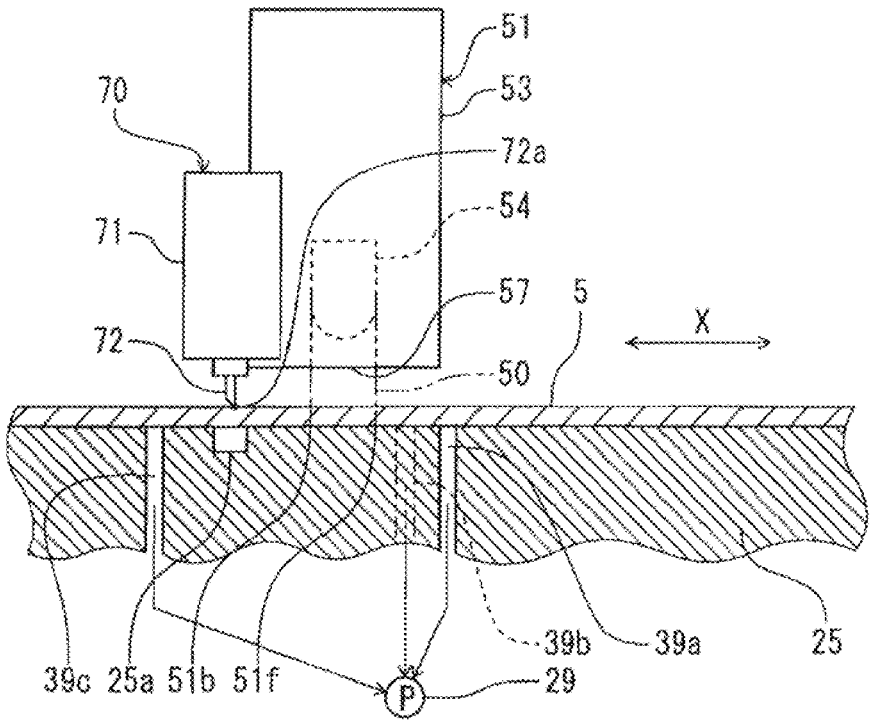
FIG. 6 is a side view of a cutting head and the first ultraviolet light irradiation device according to another embodiment of the present invention.
Figure 7:
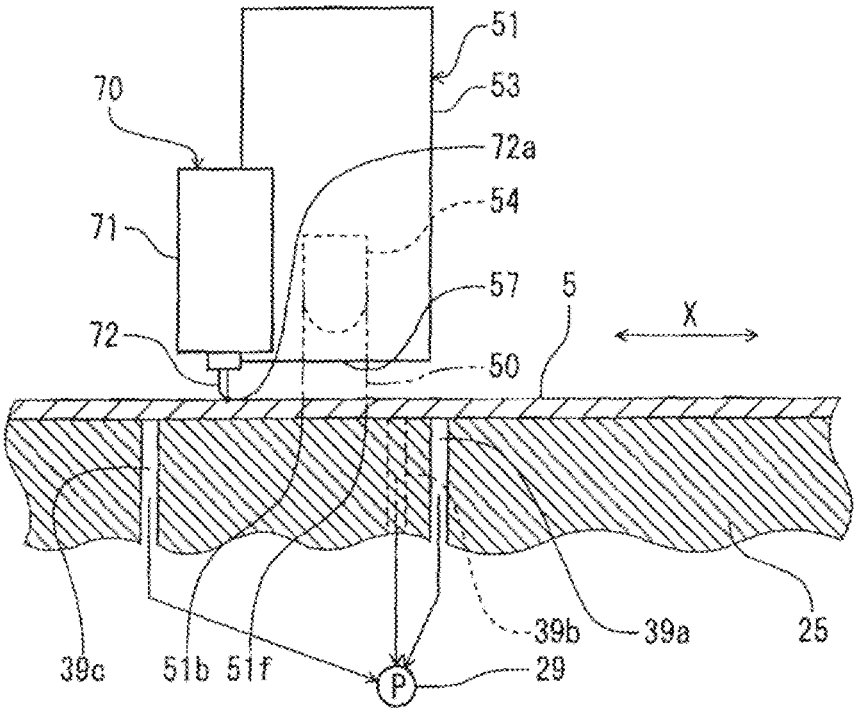
FIG. 7 is a side view of a cutting head and the first ultraviolet light irradiation device according to another embodiment of the present invention.

The sliding member 28 may not be required, and may be omitted as shown in FIG. 6. By providing the groove 25*a* in the platen 25, the cutter 72 may slide with greater ease against the recording paper 5. Additionally, as illustrated in FIG. 7, the groove 25*a* may be omitted when the cutter 72 may slide with greater ease on the platen 25.

As shown in FIG. 5A, the first ultraviolet light irradiation device 51 is equipped with the light source 54 disposed within the case 53. A transmission section 57 for transmitting ultraviolet light irradiated from the light source 54 may be formed on the lower side of the case 53.

The transmission section 57 may be composed of any material that transmits ultraviolet light, and is not limited to a particular structure. The transmission section 57 may be an aperture formed in the case 53, or may be made of a member composed of a material that transmits ultraviolet light.

Reference numeral 50 represents the ultraviolet light omitted form the light source 54 via the transmission section 57. Reference numeral 51*f* indicates the front end of a region of ultraviolet light irradiated on the recording paper 5 (hereafter referred to as an irradiated region), and reference numeral 51*b* indicates the rear end of the irradiated region. The irradiated region refers to the region between the front end 51*f* and the rear end 51*b* on the recording paper 5.

A position on the recording paper 5 immediately below the cutter 72 is referred to as a cut-out position 72*a*. As shown in FIG. 5A, at least a part of the irradiated region on the recording paper 5 is located in front of the cut-out position 72*a*. Additionally, at least a part of the irradiated region is located in front of the sliding member 28. In particular, in accordance with the present embodiment, the entire irradiated region is located in front of the cut-out position 72*a* and the sliding member 28.

As illustrated in FIG. 5B, reference numeral 52*f* indicates the front end of an irradiated region irradiated on the recording paper 5 by the second ultraviolet light irradiation device 52, and reference numeral 52*b* indicates the rear end of the irradiated region on the recording paper 5 irradiated by the second ultraviolet light irradiation device 52.

The second ultraviolet light irradiation device 52 is disposed in front of the first ultraviolet light irradiation device 51. Therefore, the entire region irradiated by the second ultraviolet light irradiation device 52 is located in front of the cut-out position 72*a* and the sliding member 28.

As shown in FIG. 2 and FIG. 5A, multiple holes 39*a*, 39*b* and 39*c* are formed in the platen 25. More specifically, as shown in FIG. 2, the multiple holes 39*a*, 39*b* and 39*c* are formed in the platen 25 and are respectively aligned in the left-right direction. The holes 39*a* are positioned in front of the holes 39*b*, and the holes 39*c* are positioned at the rear of the holes 39*b*.

As shown in FIG. 5A, the ink jet printer 1 is equipped with a pump 29 for providing suction through the holes 39*a*, 39*b* and 39*c*. The recording paper 5 is attracted to the platen 25A as the pump 29 sucks air within the holes 39*a*, 39*b* and 39*c*. As a result, the recording paper 5 is prevented from floating above the platen 25. Accordingly, the recording paper 5 can be more securely flattened on the platen 25.

It is noted that the attraction device for attracting the recording paper 5 is not limited to the pump 29. Alternate methods of securing the recording paper 5 to the platen 25 may be utilized.

As illustrated in FIG. 5A, the holes 39*a* and 39*b* are located in front of the cut-out position 72*a* and the front end 51*f* of the irradiated region. Additionally, the holes 39*c* are located at the rear of the cut-out position 72*a* and the rear end 51*b* of the irradiated region. As shown in FIG. 5B, the holes 39*a* and 39*b* are located at the rear of the rear end 52*b* of the irradiated region on the recording paper 5 formed by the second ultraviolet light irradiation device 52.

Reference numeral 52*f* indicates the front end of the irradiated region on the recording paper 5 formed by the second ultraviolet light irradiation device 52. A region between the front end 52*f* and the rear end 52*b* is referred to as the irradiated region on the recording paper 5 formed by the second ultraviolet light irradiation device 52. The holes 39*c* are located at the rear of the cut-out position 72*a* and the rear end 52*b* of the irradiated region described above.

Operations of the ink jet printer 1 will now be described. The ink jet printer 1 is capable of printing to the recording paper 5 with the ink head 40, and cutting the recording paper 5 with the cutting head 70.

At the time of printing, the ink head 40 ejects ink toward the recording paper 5 while reciprocally moving in the first scanning direction. The recording paper 5 is transferred by the rollers 26 in the second scanning direction, with the reciprocal movements of the ink head 40.

For example, as the ink head 40 is moved from one side to the other side in the first scanning direction, the recording paper 5 is transferred forward by a predetermined length. Furthermore, the ink head 40 is reversed and moved from the other side to the one side in the first scanning direction and the recording paper 5 is again transferred forward by a predetermined length, similar operations are then repeated.

By these operations, a two-dimensional image may be formed on the recording paper 5. Also, the ultraviolet light irradiation devices 51 and 52 are suitably operated with the movements of the ink head 40 in the first scanning direction. Therefore, ultraviolet light is irradiated on the ink discharged on the recording paper 5. Then, the ink on the recording paper 5 is cured and fixed on the recording paper 5.

It is noted that the transfer direction of the recording paper 5 at the time of printing is not limited to the forward direction. After completing printing on a predetermined region of the recording paper 5, the recording paper 5 may be moved backward, and the predetermined region may be printed again. In other words, a plurality of inks may be superposed on the recording paper 5.

During the cutting operation, the ink head 40 remains at the HP in a separated state from the cutting head 70, as previously described. The cutting head 70 moves in the first scanning direction. When the cutting head 70 moves to a predetermined position above the recording paper 5, the cutter 72 of the cutting head 70 (see FIG. 4) is lowered, thereby cutting the recording paper 5.

While maintaining the state in which the cutter 7 penetrates the recording paper 5, the cutting head 70 moves in the first scanning direction, and the recording paper 5 is transferred by the rollers 26 in the second scanning direction. By this, the recording paper 5 is cut out in a predetermined shape.

As shown in FIG. 5A, in accordance with the present embodiment, the irradiated region on the recording paper 5 irradiated by the first ultraviolet light irradiation device 51 is located in front of the cut-out position 72*a* in the recording paper 5 cut by the cutter 72. Therefore, even if ultraviolet light curable ink were adhered to a portion on the platen 25 corresponding to the cut-out position 72*a*, ultraviolet light would not be irradiated on the ink by the first ultraviolet light irradiation device 51. Therefore, ink can be prevented from being cured at the portion on the platen 25 corresponding to the cut-out position 72*a*.

Accordingly, the recording paper 5 may be weighed down due to cured ink at the cut-out position 72*a* and may be prevented from contacting cured ink when the cutter 72 penetrates the recording paper 5 in the up-down direction. Accordingly, preventing the curing of the ink allows the cutter 72 to slide more easily at the cut-out position 72*a*. Therefore, the cutting operation by the cutter 72 can be conducted favorably by the ink jet printer 1 in accordance with the present embodiment even if ultraviolet light curable ink were cured on the platen 25.

Also, as shown in FIG. 5A, the ink jet printer 1 in accordance with the present embodiment is equipped with the sliding member 28 disposed at a position opposite to the cutter 72, and the irradiated region on the recording paper 5 formed by the first ultraviolet light irradiation device 51 is located in front of the sliding member 28. Therefore, ink would not be cured by the first ultraviolet light irradiation device 51 over the sliding member 28. Accordingly, lubricity by the sliding member 28 on the cutter 72 would not be hampered and the cutting operation by the cutter 72 can be favorably conducted.

Moreover, as shown in FIG. 5A, the ink jet printer 1 in accordance with the present embodiment may include a plurality of holes 39*a*, 39*b* and 39*c* formed in the platen 25. The recording paper 5 on the platen 25 is attracted by the pump 29 via the holes 39*a*, 39*b* and 39*c*.

Thus, as a result of attracting the recording paper 5 on the platen 35, the recording paper 5 may be more flat. Accordingly, printing by the ink head 40, curing of ink on the recording paper 5 by the ultraviolet light irradiation devices 51 and 52, and cutting by the cutting head 70 can more precisely executed as a result of the flat paper.

Further, the positions of the holes 39*a*, 39*b* and 39*c* are shifted from the cut-out position 72 and the first ultraviolet light irradiation device 51 in the front-rear direction. Therefore, the holes 39*a*, 39*b* and 39*c* would not prevent the cut-out operations by the cutter 72.

Additionally, if ultraviolet light curable ink entered the holes 39*a*, 39*b* or 39*c*, the ink would not be cured by the first ultraviolet light irradiation device 51. Therefore, the holes 39*a*, 39*b* and 39*c* may be prevented from being closed by cured ink.

In accordance with the present embodiment, the holes 39*a* and the holes 39*b* are located in front of the cut-out position 72*a*. Additionally, the holes 39*c* are located at the rear of the cut-out position 72*a*.

While the previously described effects are achieved, the recording paper 5 can be attracted to the platen 25 by the multiple holes 39*a*, 39*b* and 39*c* that are separated relatively far from one another in the front-rear direction. Therefore, the recording paper 5 can be flattened with higher precision.

As shown in FIG. 3, the ink jet printer 1 in accordance with the present embodiment is equipped with the coupling mechanism 30 that detachably couples the ink head 40 and the cutting head 70. The first ultraviolet light irradiation device 51 is located between the ink head 40 and the cutting head 70 along the left-right direction.

When the first ultraviolet light irradiation device 51 is operated at the time of printing, the cutting head 70, the first ultraviolet light irradiation device 51 and the ink head 40 move in one piece in the first scanning direction. Accordingly, the first ultraviolet light irradiation device 51 may be attached to the cutting head 70, instead of the ink head 40.

However, in accordance with the present embodiment, the first ultraviolet light irradiation device 51 is attached to the ink head 40. For this reason, when the connection between the ink head 40 and the cutting head 70 is released, the cutting head 70 is separated not only from the ink head 40, but also from the first ultraviolet light irradiation device 51. Accordingly, the load on the carriage 73 may be alleviated at the time of cut-out operations by the cutting head 70.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A printing apparatus capable of performing printing and cutting operations, the printing apparatus comprising:

a supporting member for supporting a medium;

a first transfer mechanism for transferring the supported medium in a first direction;

a guide rail that extends in a second direction;

an ink head comprising a nozzle for discharging ultraviolet light curable ink onto the transferred medium and coupled to the guide rail in a freely moveable manner for moving the ink head in the second direction;

a cutting head comprising a cutter for cutting the transferred medium and coupled to the guide rail in a freely moveable manner for moving the cutting head in the second direction;

a second transfer mechanism for moving the ink head and the cutting head in the second direction during the printing operation and moving the cutting head in the second direction during the cutting operation; and an ultraviolet light irradiation device coupled to the ink head for irradiating ultraviolet light onto the discharged ultraviolet light curable ink during the printing operation; and a coupling mechanism located at a rear of the ultraviolet light irradiation device and being configured to detachably couple the cutting head and the ink head, wherein:

at least a portion of the medium is irradiated by the ultraviolet light after a region of the medium is cut by the cutter; and the cutting head is adjacent and in the second direction relative to the ultraviolet light irradiation device.

2. The printing apparatus of claim 1, further comprising a sliding groove located opposite to the cutter and on the supporting member, wherein the sliding groove comprises a sliding member for receiving the cutter during the cutting operation and having a greater lubricity for the cutter than the lubricity the supporting member has for the cutter.

3. The printing apparatus of claim 1, further comprising:

a plurality of holes formed on the supporting member; and a suction device for attracting the medium to the supporting member via the plurality of holes.

4. The printing apparatus of claim 3, wherein a position of each of the plurality of holes is shifted in the first direction and away from a cut position and an irradiated region.

5. The printing apparatus of claim 3, wherein:

a first portion of the plurality of holes is located at a front of a cut position and an irradiated region; and a second portion of the plurality of holes is located at a rear of the cut position and the irradiated region.

6. The printing apparatus of claim 1, wherein the coupling mechanism is configured to detachably couple the ink head and the cutting head during the printing operation and is further configured to release the coupling of the ink head and the cutting head during the cutting operation.

7. The printing apparatus of claim 1, further comprising a carriage coupled to the second transfer mechanism and for transferring the cutting head in the second direction.

8. The printing apparatus of claim 1, wherein the ultraviolet light irradiation device is located between the ink head and the cutting head.

9. The printing apparatus of claim 1, wherein:

the first direction is a front-back direction relative to a front of the printing apparatus; and the second direction is a left-right direction relative to the front of the printing apparatus.

10. A method of printing, and cutting, the method comprising:

supporting a medium;

transferring the supported medium in a first direction;

discharging ultraviolet light curable ink from an ink head onto the transferred medium, wherein the ink head is freely moveable in a second direction;

cutting the transferred medium via a cutting head comprising a cutter, wherein the cutting head is freely moveable in the second direction;

detachably coupling the cutting head and the ink head via a coupling mechanism that is located at a rear of an ultraviolet light irradiation device;

moving the ink head and the cutting head in the second direction during a printing operation;

moving the cutting head in the second direction during a cutting operation; and irradiating ultraviolet light onto the discharged ultraviolet light curable ink via the ultraviolet light irradiation device during the printing operation, wherein:

at least a portion of the recoding medium is irradiated by the ultraviolet light after a region of the medium is cut by the cutter; and the cutting head is adjacent and in the second direction relative to the ultraviolet light irradiation device.

11. The method according to claim 10, further comprising receiving the cutter via a sliding member positioned in a sliding groove disposed opposite to the cutter on the supporting member, wherein the sliding member has a greater lubricity for the cutter than the lubricity the supporting member has for the cutter.

12. The method of claim 10, further comprising attracting the medium to the supporting member via a suction member using a plurality of holes formed on the supporting member.

13. The method of claim 10, wherein the ink head is detachably coupled to the cutting head at a time of the printing operation and is further configured to release the coupling of the ink head and the cutting head.

14. The method of claim 10, further comprising transferring the cutting head in the second direction.

15. The method of claim 10, wherein:

the first direction is a front-back direction relative to a front of an apparatus; and the second direction is a left-right direction relative to the front of the apparatus.

16. The method of claim 10, wherein:

the ultraviolet light is irradiated onto the ultraviolet light curable ink via the ultraviolet light irradiation device; and the ultraviolet light irradiation device is located between the ink head and the cutting head.

17. A printing apparatus for performing printing and cutting operations, the printing apparatus comprising:

a supporting member for supporting a medium;

a first transfer mechanism for transferring the medium in a first direction;

a guide rail extending in a second direction;

an ink head comprising a nozzle for discharging ultraviolet light curable in onto the medium and coupled to the guide rail in a freely moveable manner, the guide rail guiding movement of the ink head in the second direction;

a cutting head comprising a cutter for cutting the medium and coupled to the guide rail in a freely moveable manner, the guide rail further guiding movement of the cutting head in the second direction;

a second transfer mechanism for moving the ink head and the cutting head in the second direction during the printing operation and moving the cutting head in the second direction during the cutting operation;

an ultraviolet light irradiation device coupled to the ink head and for irradiating ultraviolet light onto the discharged ultraviolet light curable ink during the printing operation; and a coupling mechanism located at the rear of the ultraviolet light irradiation device, the coupling mechanism being configured to detachable couple the ink head and the cutting head, to connect the ink head and the cutting head during the printing operation, and to release the connection between the ink head and the cutting head during the cutting operation, wherein:

at least a portion of the medium is irradiated by the ultraviolet light after a region of the medium is cut by the cutter; and the cutting head is adjacent and in the second direction relative to the ultraviolet light irradiation device.

18. The printing apparatus of claim 17, further comprising a sliding groove located opposite to the cutter and on the supporting member, wherein the sliding groove comprises a sliding member for receiving the cutter during the cutting operation and having a greater lubricity for the cutter than the lubricity the supporting member has for the cutter.

19. The printing apparatus of claim 17, further comprising:

a plurality of holes formed on the supporting member; and a suction device for attracting the medium to the supporting member via the plurality of holes.

20. The printing apparatus of claim 19, wherein a position of each of the plurality of holes is shifted in the first direction and away from a cut position and an irradiated region.

21. The printing apparatus of claim 19, wherein:

a first portion of the plurality of holes is located at a front of a cut position and an irradiated region; and a second portion of the plurality of holes is located at a rear of the cut position and the irradiated region.

* * * * *